US011849862B2

(12) United States Patent
Silinski

(10) Patent No.: US 11,849,862 B2
(45) Date of Patent: Dec. 26, 2023

(54) FOLDABLE SIDE TABLE FOR A COLLAPSIBLE CHAIR AND A COMBINATION COLLAPSIBLE CHAIR WITH A FOLDABLE SIDE TABLE

(71) Applicant: Rio Brands, LLC, Watertown, CT (US)

(72) Inventor: Robert John Silinski, Bethel Park, PA (US)

(73) Assignee: ShelterLogic Corp., Watertown, CT (US)

( * ) Notice: Subject to any disclaimer, the term of this patent is extended or adjusted under 35 U.S.C. 154(b) by 50 days.

(21) Appl. No.: 17/314,337

(22) Filed: May 7, 2021

(65) Prior Publication Data

US 2021/0345785 A1 Nov. 11, 2021

Related U.S. Application Data

(60) Provisional application No. 63/022,668, filed on May 11, 2020.

(51) Int. Cl.

| | |
|---|---|
| ***A47C 7/70*** | (2006.01) |
| ***A47C 7/62*** | (2006.01) |
| ***A47C 4/28*** | (2006.01) |

(52) U.S. Cl.

CPC ..... *A47C 7/70* (2013.01); *A47C 4/286* (2013.01); *A47C 7/624* (2018.08)

(58) Field of Classification Search

CPC ..... A47C 7/70; A47C 7/624

See application file for complete search history.

(56) References Cited

U.S. PATENT DOCUMENTS

| | | | |
|---|---|---|---|
| 2,447,391 | A | 8/1948 | Brandes et al. |
| 3,864,223 | A | 2/1975 | Colwell et al. |
| 3,894,496 | A | 7/1975 | Phillips et al. |

(Continued)

FOREIGN PATENT DOCUMENTS

| | | | |
|---|---|---|---|
| JP | 3014200 | U | 2/1995 |

*Primary Examiner* — Anthony D Barfield

(74) *Attorney, Agent, or Firm* — Carmody Torrance Sandak & Hennessey LLP

(57) ABSTRACT

A combination chair and foldable side table, wherein the combination includes the chair, wherein the chair comprises at least a first leg and a second leg, at least a first member coupled to the first leg and a second member coupled to the second leg, wherein the first member includes a slot and/or the mounting of the first member on the first leg forms a slot between the first member and the first leg and wherein the second member includes a slot and/or the mounting of the second member on the second leg forms a slot between the second member and the second leg; and the foldable side table includes a first arm and a second arm, a first hand depending from the first arm and removably insertable into the slot associated with the first member, and a second hand depending from the second arm and removably insertable into the slot associated with the second member; a first cross-member assembly coupled intermediate the first and second arms and a second cross-member assembly coupled intermediate the first and second arms; and a flexible covering coupled to the first and second arms. The present invention is also directed to the foldable side table itself, which can also include the members disclosed herein.

17 Claims, 5 Drawing Sheets

(56) References Cited

U.S. PATENT DOCUMENTS

| | | | | |
|---|---|---|---|---|
| 5,564,779 | A | 10/1996 | Tolbert et al. | |
| 5,649,737 | A | 7/1997 | Behnke | |
| 5,660,432 | A | 8/1997 | Davis | |
| 6,062,640 | A * | 5/2000 | Stahl | A47C 7/70 297/135 |
| 6,193,308 | B1 | 2/2001 | Hwang | |
| 6,364,411 | B1 | 4/2002 | Zheng | |
| 8,186,755 | B2 | 5/2012 | Lovley | |
| 8,905,471 | B2 | 12/2014 | Tang | |
| 9,332,849 | B2 | 5/2016 | Wagner et al. | |
| 9,877,587 | B2 * | 1/2018 | Grace | A47C 7/62 |
| 10,362,875 | B2 | 7/2019 | Grace | |
| 2007/0216201 | A1 | 9/2007 | Hart | |
| 2011/0227374 | A1 | 9/2011 | Zhu et al. | |
| 2012/0055378 | A1 | 3/2012 | Stamper et al. | |
| 2014/0327277 | A1 | 11/2014 | Dudik | |
| 2020/0022498 | A1 | 1/2020 | Howell | |

* cited by examiner

FOLDABLE SIDE TABLE FOR A COLLAPSIBLE CHAIR AND A COMBINATION COLLAPSIBLE CHAIR WITH A FOLDABLE SIDE TABLE

FIELD OF THE INVENTION

The present invention relates to foldable side tables for a chair and to a foldable side table combination with a foldable and/or collapsible chair.

BACKGROUND OF THE INVENTION

Collapsible or foldable chairs provide portable seating at a variety of events, both indoor and outdoor. At such events, a user may have a variety of items, including beverages, a cellphone, a camera and the like. Depending on the type of collapsible or foldable chair, a beverage holder may be included with the chair. However, the beverage holder has limited use and, in many cases, cannot safely support multiple items. Thus, side tables for collapsible or foldable chairs are known in the art, for example as described in U.S. Pat. No. 6,193,308 to Hwang, U.S. Pat. No. 6,364,411 to Zheng, U.S. Pat. No. 9,332,849 to Wagner et al., and U.S. Pat. No. 10,362,875 to Grace.

However, it has been discovered that improvements to such constructions are desired, especially for foldable side tables for collapsible or foldable chairs. Specifically, it is desirable and has been found to be achievable to improve such collapsible or foldable side table constructions by providing an independent foldable side table construction with a cross-member assembly and arm construction that is independent to the movement of the chair, which improves the sturdiness and integrity of the side table and reduces the footprint of the side table and the chair assembly when in the collapsed or folded position (e.g., during storage). In addition, an improved construction of the chair to permit the side table mountability on the collapsible or foldable chair is desired, which improves the combination chair and side table functionality, all of which is also desirable. These and other embodiments will be disclosed herein.

SUMMARY OF THE INVENTION

It is an object of the present invention to overcome the deficiencies in the prior art.

For example, it is an objective of the present invention to provide an improved collapsible or foldable chair construction that receives a foldable side table.

Another objective of the present invention is to provide an improved foldable side table that has improved structural integrity during use/deployment, when used with the preferred chair constructions as set forth herein.

The present invention is applicable and may be appreciated with a variety of foldable and/or collapsible chairs, although in preferred embodiments, it is a particular objective of the present invention to provide a foldable side table for use with a generally described "quad" or "director's" chair, wherein the construction to permit mounting of the side table thereon and the foldable side table itself both have increased structural integrity during use/deployment and/or during storage or transport of the chair and/or side table.

The present invention achieves the aforementioned objectives as well as others as disclosed herein and is thus generally directed in a first preferred embodiment to a combination chair and foldable side table, wherein the combination comprises the chair, wherein the chair comprises at least a first leg and a second leg; at least a first member coupled to the first leg and a second member coupled to the second leg, wherein the first member includes a slot and/or the mounting of the first member on the first leg forms a slot between the first member and the first leg and wherein the second member includes a slot and/or the mounting of the second member on the second leg forms a slot between the second member and the second leg; and the foldable side table comprises a first arm and a second arm, a first hand depending from the first arm and removably insertable into the slot associated with the first member, and a second hand depending from the second arm and removably insertable into the slot associated with the second member; a first cross-member assembly coupled intermediate the first and second arms and a second cross-member assembly coupled intermediate the first and second arms; and a flexible covering coupled to the first and second arms.

The present invention is also directed to foldable side table for use with a chair having at least a first leg and a second leg, and at least a first member coupled to the first leg and a second member coupled to the second leg, wherein the first member includes a slot and/or the mounting of the first member on the first leg forms a slot between the first member and the first leg and wherein the second member includes a slot and/or the mounting of the second member on the second leg forms a slot between the second member and the second leg; and wherein the foldable side table comprises a first arm and a second arm, a first hand depending from the first arm and removably insertable into the slot associated with the first member, and a second hand depending from the second arm and removably insertable into the slot associated with the second member; a first cross-member assembly coupled intermediate the first and second arms and a second cross-member assembly coupled intermediate the first and second arms; and a flexible covering coupled to the first and second arms.

The present invention is also directed to a foldable side table assembly for use with a chair having at least a first leg and a second leg, wherein the foldable side table assembly comprises at least a first member couplable to the first leg and a second member couplable to the second leg, wherein the first member includes a slot and/or the mounting of the first member on the first leg forms a slot between the first member and the first leg and wherein the second member includes a slot and/or the mounting of the second member on the second leg forms a slot between the second member and the second leg; a first arm and a second arm, a first hand depending from the first arm and removably insertable into the slot associated with the first member, and a second hand depending from the second arm and removably insertable into the slot associated with the second member; a first cross-member assembly coupled intermediate the first and second arms and a second cross-member assembly coupled intermediate the first and second arms; and a flexible covering coupled to the first and second arms.

In a specific preferred embodiment, the collapsible or foldable chair is a quad or director's chair. It should also be understood that all the features described herein are applicable to each of the embodiments disclosed herein.

BRIEF DESCRIPTION OF THE DRAWINGS

Features and aspects of embodiments are described below with reference to the accompanying drawings, in which elements are not necessarily depicted to scale.

Exemplary embodiments of the present disclosure are further described with reference to the appended figures. It is to be noted that the various features, steps and combinations of features/steps described below and illustrated in the figures can be arranged and organized differently to result in embodiments which are still within the scope of the present disclosure.

Figure 1:
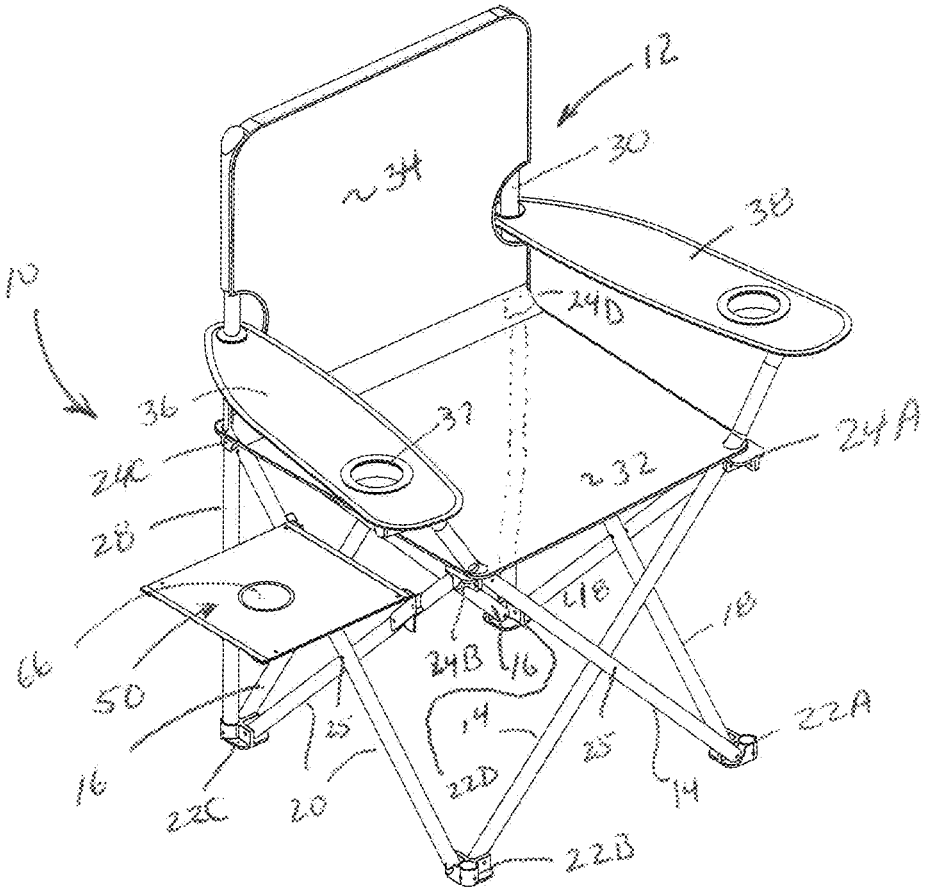
Figure 2:
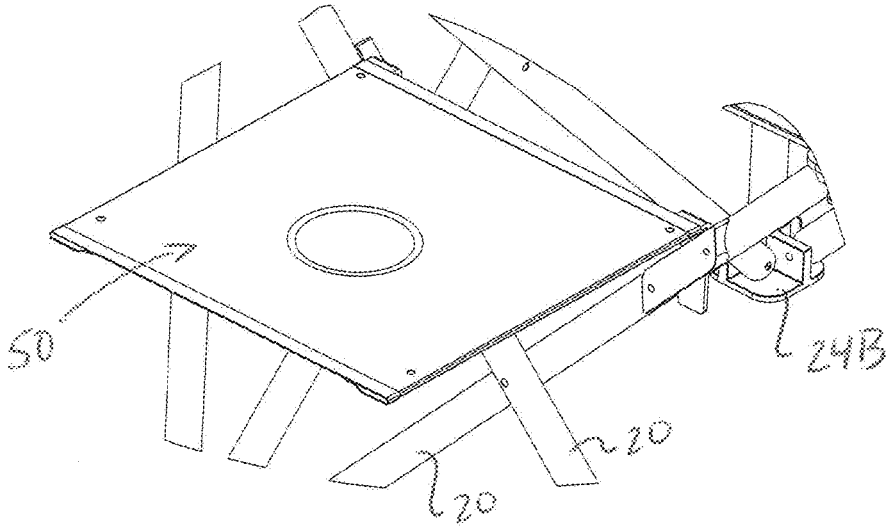
Figure 3:
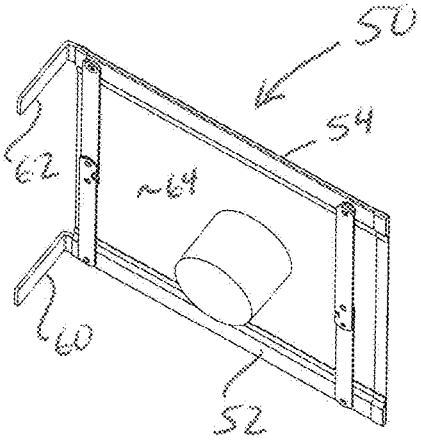
Figure 4:
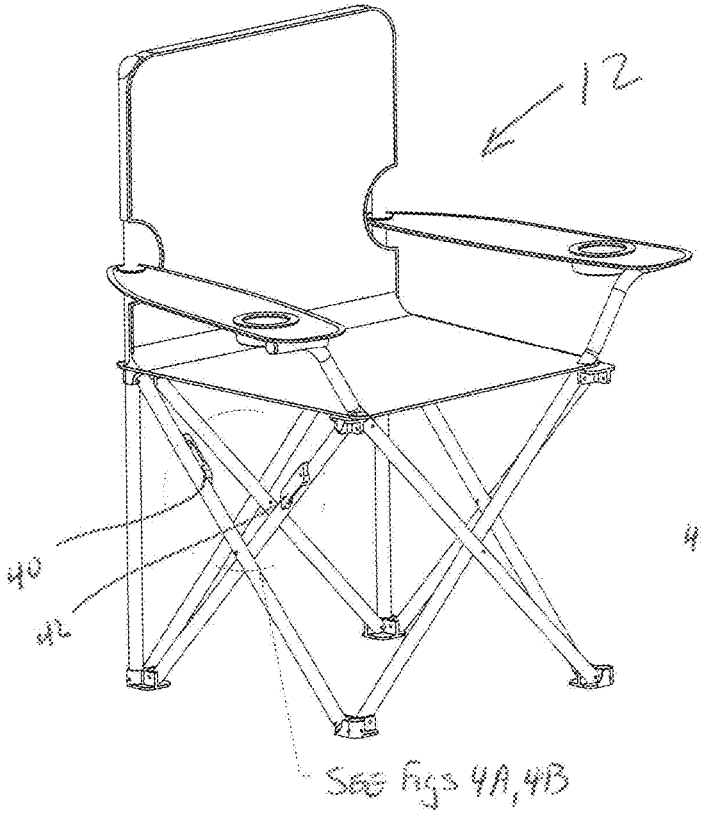
Figure 4A:
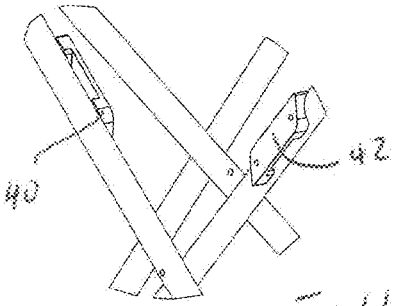
Figure 4B:
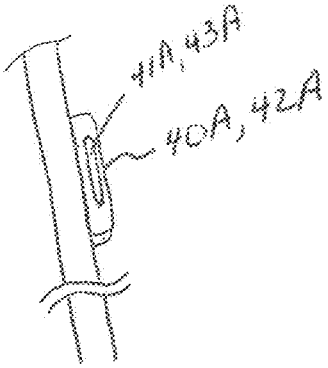
Figure 5:
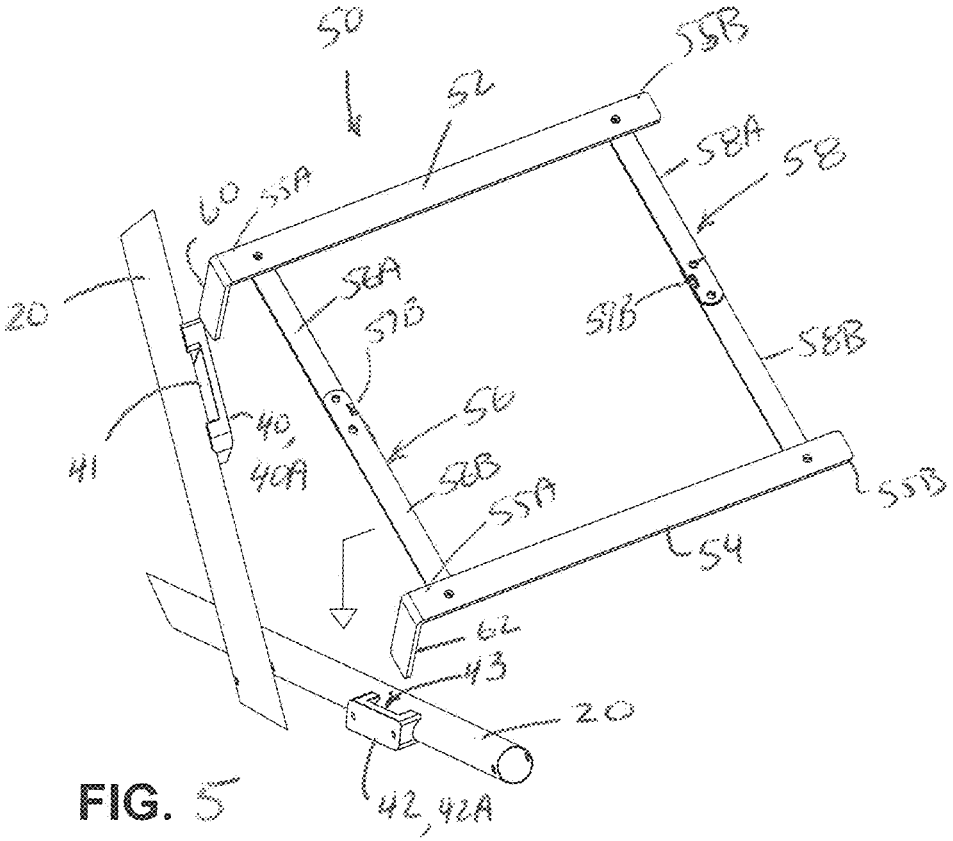
Figure 6:
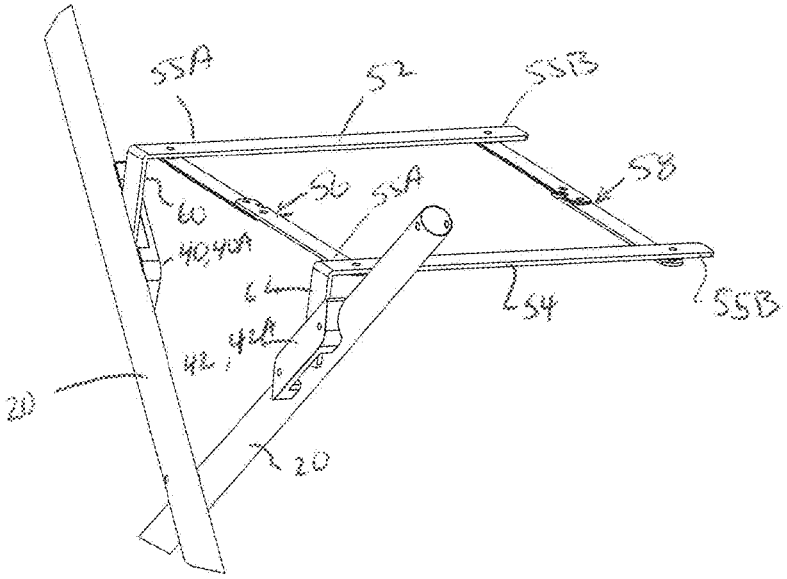
Figure 7:
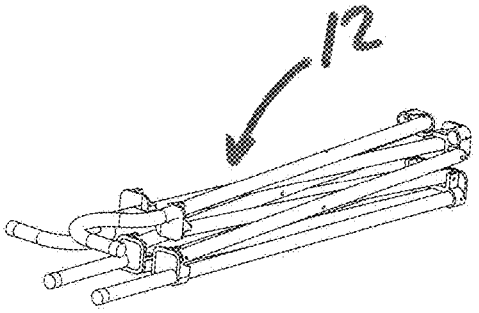
Figure 8:
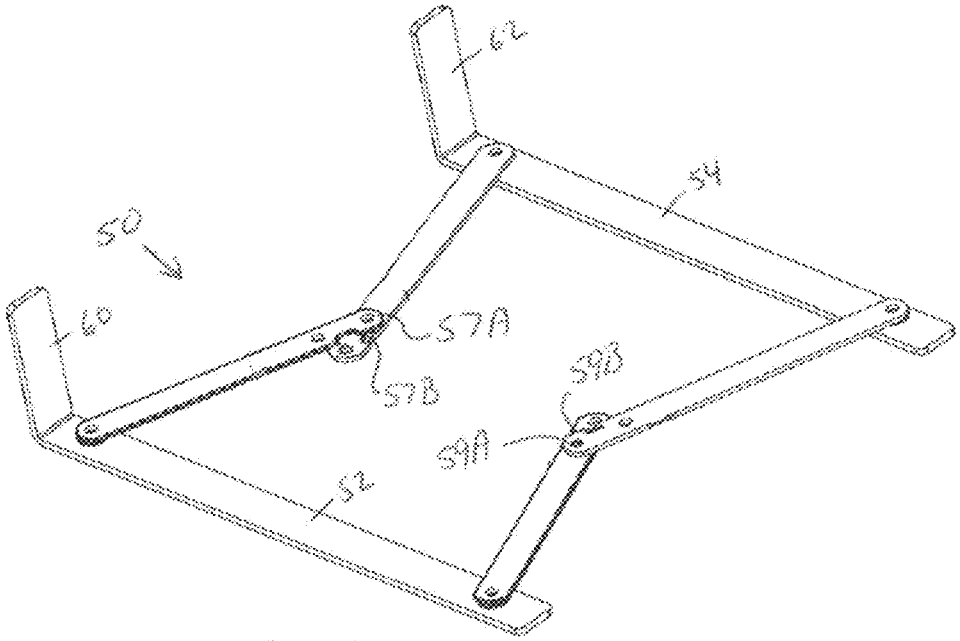

To assist those of ordinary skill in the art in making and using the disclosed assemblies, systems and methods, reference is made to the appended figures, wherein:

FIG. 1 illustrates a perspective view of a collapsible chair and a foldable side table combination constructed in accordance with preferred embodiments of the present invention;

FIG. 2 illustrates a detailed perspective view of a foldable side table constructed in accordance with preferred embodiments of the present invention, secured to a collapsible chair;

FIG. 3 illustrates a perspective view of a foldable side table according to preferred embodiments of the present invention;

FIG. 4 illustrates a perspective view of a collapsible chair preferable with use in connection with preferred embodiments of the present invention;

FIGS. 4A, 4B illustrate alternative embodiment's of features of the present invention;

FIGS. 5 and 6 illustrate detailed features of a collapsible chair and a removable, foldable side table all in accordance with preferred embodiments of the present invention;

FIG. 7 illustrates the frame of a collapsible chair in a collapsed position according to preferred embodiments of the present invention; and FIG. 8 illustrates a foldable side table in a collapsed and collapsing position according to preferred embodiments of the present invention.

Not all features in every figure has a reference number but like reference numbers refer to like parts in the figures.

DETAILED DESCRIPTION OF THE PREFERRED EMBODIMENTS

The present invention is directed to a foldable side table for use with a collapsible chair and a combination foldable side table and collapsible chair, all of which has improved structural integrity during use/deployment and/or during storage or transport. The present invention provides a combination of a collapsible or foldable chair with a foldable side table and a foldable side table for use with said collapsible or foldable chair.

As used herein, "a," "an," and "the" refer to both singular and plural references unless the context clearly dictates otherwise.

As used herein, the term "about" refers to a measurable value such as a parameter, an amount, a temporal duration, and the like and is meant to include variations of +/−15% or less, preferably variations of +/−10% or less, more preferably variations of +/−5% or less, even more preferably variations of +/−1% or less, and still more preferably variations of +/−0.1% or less of and from the particularly recited value, in so far as such variations are appropriate to perform in the invention described herein.

As used herein, spatially relative terms, such as "beneath", "below", "lower", "above", "upper", "front", "back", "side", "left", "right", "rear", and the like, are used for ease of description to describe one element or feature's relationship to another element(s) or feature(s). It is further understood that the terms "front", "rear", "left" and "right" are not intended to be limiting and are intended to be interchangeable where appropriate.

As used herein, the term "collapsible chair" and "folding chair" may be used synonymously or interchangeably and together may refer to a chair that can be quickly and easily collapsed and/or folded and stored in a more compact configuration, including but not limited to, a quad chair, a director's chair, a lawn chair, a beach chair, and a camp chair. Thus, any reference herein to a collapsible chair shall also include and encompass foldable chairs and any reference herein to a foldable chair shall also include and encompass collapsible chairs.

In a preferred embodiment, the collapsible and/or foldable chair is as described and disclosed in U.S. Pat. No. 8,864,223 and/or 8,186,755, the subject matter of which are both incorporated herein in their respective entireties for purposes of the disclosure and understanding of the preferred "quad" or "director's" chair construction. Although believed to be well understood in the art, the following is provided for the convenience of the reader and to ensure full enablement of the present invention.

Specifically, the preferred collapsible or foldable "director's" or "quad" chair for most easily appreciating the present invention includes a frame that defines a framework for the chair, generally indicated at 12. The frame is selectively moveable between a collapsed configuration (FIG. 8) and a use configuration (FIGS. 1, 4, 5, 6). For example, the frame may be folded to form the collapsed configuration such that the width of the frame is substantially decreased and the chair 12 may be stored in, for example, a trunk of a car or a closet. Alternatively, the frame may be extended from the collapsed configuration to form the use configuration wherein the width of the frame is substantially increased and a user may sit on the chair 12. The frame may be fabricated from plastic, metal (e.g., steel, aluminum) or any suitable material that enables the chair to function as described herein.

The frame includes a plurality of segments that define a base portion and a top portion. A fabric frame cover is coupled to the frame to define a seat portion, a back portion, and two arms of the chair 12. More specifically, a portion of the fabric frame cover is coupled to the frame base portion to define the seat portion and a portion of the fabric frame cover is coupled to the frame top portion to define the back portion. Accordingly, during use, the user may be seated on the seat portion and the user may position his or her back against the back portion. In a preferred embodiment, the seat portion and back portion of the fabric frame cover are formed as a single-piece. It is understood, however, that the seat portion and back portion can be formed as separate pieces. The preferred quad/director's chair construction includes a pair of arms, one of which extends outward from the right side of the back portion and the other arm extends outward from the left side of the back portion (as viewed in FIG. 1). The arms are spaced apart by a predefined distance, such as, for example, approximately a width of the seat portion. Accordingly, when the user is seated on the seat portion, the user may have each arm positioned on one of the arms. The arms may be being fabricated and defined by the fabric frame cover or the arms can also be fabricated separate from the fabric frame cover and/or made from other suitable materials.

Again, chairs of the foregoing construction can be found in U.S. Pat. Nos. 8,864,223 and/or 8,186,755, the subject matters of which are incorporated herein by reference as if fully set forth herein.

Referring further in detail to the figures, and FIGS. 1 and 4 for example, a collapsible chair 12 may include a plurality of legs 14, 16, 18, 20, wherein the plurality of legs 14, 16, 18, 20 may be defined as front, rear, left and right legs. In some embodiments, the plurality of legs include a front pair of cross legs 14, a rear pair of cross legs 16, a right pair of cross legs 18 and a left pair of cross legs 20. The cross legs may be pivotally coupled to each other, for example, approximately in the middle of the cross legs. The legs may be pivotally coupled to each other using a fastener 25 (e.g., a bolt/nut combination, a rivet, a pin, or the like) and/or supporting members. In either instance, the pivoting fasteners or supporting members may enable the cross legs to pivot about different axis and thus enable the collapsible chair to collapse in multiple directions.

The cross legs may be coupled to each other at their upper and lower ends using one or more members. The cross legs may be pivotally coupled to a base plate member, for example, base plate member 22A may be pivotally coupled to cross legs 14 and cross legs 18, base plate member 22B may be pivotally coupled to cross legs 14 and cross legs 20, base plate member 22C may be pivotally coupled to cross legs 20 and cross legs 16 and base plate member 22D may be pivotally coupled to cross legs 16 and cross legs 18. The cross legs may be pivotally coupled to a top member, for example, top member 24A may be pivotally coupled to cross legs 14 and cross legs 18, top member 24B may be pivotally coupled to cross legs 14 and cross legs 20, top member 24C may be pivotally coupled to cross legs 20 and cross legs 16 and top member 24D may be pivotally coupled to cross legs 16 and cross legs 18. A pair of vertical legs 28, 30 may be slidably and pivotally coupled to at least a base plate member and a top member. The vertical leg 28 may be coupled to base plate member 22C and top member 24C, which are coupled to cross legs 20 and cross legs 16. The vertical leg 30 may be coupled to base plate member 22D and top member 24D, which are coupled to cross legs 16 and cross legs 18. In one embodiment, a top portion of the plurality of cross legs may be configured to move vertically relative to the pair of vertical legs 28, 30 during collapse and deployment of the collapsible chair 12.

In one embodiment, a seat 32 and a back rest 34 are affixed to the chair frame so that the seat 32 and the back rest 34 form a chair when the collapsible chair 12 is in the deployed position. The seat 32 and back rest 34 may be fabricated from a single piece of material or from separate pieces of material. The collapsible chair 12 may further include arm rests 36, 38 which may be supported at a position (e.g., a movable position) along the vertical legs 28, 30 and at a position along the front cross legs 14, right cross legs 18, and/or left cross legs 20. One or more arm rest(s) 36, 38 may include a pocket 37, which may be configured to hold a beverage or other item.

In accordance with a preferred embodiment of the invention, a combination collapsible chair and folding side table is provided and generally indicated at 10, comprising the collapsible chair 12 and a foldable side table, generally indicated at 50, as exemplary depicted in FIG. 1, among other figures. The foldable side table 50 is preferably removably coupled to one or more cross legs of chair 12 as disclosed below and as illustrated in the figures.

For example, the foldable side table 50 is removably coupled to one of the pair of cross legs, e.g. cross legs 20. However, it should be appreciated that the foldable side table 50 may be coupled to one or more other pairs of cross legs, without departing from the spirit/scope of this disclosure. As illustrated in FIGS. 5, 6, the foldable side table 50 may include a first arm 52 and a second arm 54, each arm having a respective first end 55A and a second end 55B, wherein the first end 55A of each arm includes a depending hand 60, 62 for coupling to the cross legs, e.g. legs 20. Preferably, each hand is integrally formed with its respective arms 52, 54.

A first cross-member assembly, generally indicated at 56, and a second cross-member assembly, generally indicated at 58, may be positioned with respect to the first and second arms 52, 54. For example, the first and second cross-member assemblies 56, 58 are spaced apart from each other and aligned perpendicular to the first and second arms 52, 54 such that the cross-members assemblies are coupled to both the first and second arms 52, 54 as illustrated in FIGS. 5, 6. The first cross-member assembly 56 may be mounted with respect to each first end 55A and may couple the first and second arms 52, 54 together. Similarly, the second cross-member assembly 58 may be mounted with respect to respective second ends 55B and may also couple the first and second arms 52, 54 together. The first and second cross-members 56, 58 may be oppositely positioned and, in combination with the first and second arms, may define a quadrilateral in a deployed configuration. In an exemplary embodiment, the first and second cross-member assemblies may be configured for pivotal movement. The first and second cross-member assemblies may pivotally move between an open position, such that the first and second arms 52, 54 are at a first spaced distance from each other (e.g. FIG. 5, 6), and a folded position such that the first and second arms 52, 54 are at a second distance from each other, for example when the chair is collapsed (e.g. see FIG. 7 showing the chair frame in a collapsed position and FIG. 8 showing the folding table in a collapsed and/or collapsing position). In the open position, the foldable side table 50 may be such that the first and second arms 52, 54 are the furthest away from each other and the first and second cross-members assemblies parallel to each other. In the folded position, the foldable side table 50 may be such that the first and second arms 52, 54 are closer to each other than in the open position and the first and second cross-members assemblies are not parallel (e.g. FIG. 8). The first and second cross-member assemblies may respectively move around respective pivot points 57A, 59A (e.g. FIG. 8) and may move between about 0° and about 180°. The first and second cross-member assemblies may include respective stop features 57B, 59B such that the cross-members do not pivot further than desired (e.g., about 0° and about 180°).

More specifically, the first cross-member assembly 56 is preferably constructed identically with the second cross-member assembly 58. Therefore, reference to one assembly should be understood to include a disclosure of the other. Each assembly 56, 58 is preferably and respectively comprised of first connector arms 56A, 58A and second connector arms 56B, 58B.

As preferably constructed, one end of connector arm 56A is coupled to a first end of arm 52 by way of a screw, rivet or other conventional coupling means. Similarly, an end of connector arm 56B is coupled to a first end of arm 54 by way of a screw, rivet or other conventional coupling means. The other ends of connector arms 56A, 56B are hingedly coupled together by a rivet, screw or other conventional coupling means, indicated at 57A. The stop features, generally indicated at 57B preferably comprise a tab and recess combination to prevent the respective pairs of connector arms from overrotation when arms 52, 54 are fully extended away from each other by way of the being received in the recess and the resulting inability of the connected ends of connector arm 56A, 56B being rotated past 180 degrees.

Reference to "the end" or "end" in this disclosure is not intended to be taken literally as meaning the very "tip" of any structure/member/arm or support. Rather, and as the figures illustrate, for example, the respective tabs, recesses, and coupling means are not provided at the exact "end" of the respective arms or connector arms or supports but rather towards and/or near the respective ends, as shown in the figures. This should be understood and clear to one ordinarily skilled in the art.

As should now be understood, side table 50 can be closed/collapsed by causing (e.g. pressing) the respective pair of connector arms so that the angle of the respective arm pairs rotate from their 180 degree alignment (e.g. FIGS. 5, 6) to that (e.g.) as illustrated in FIG. 8. Then, (e.g.) continued urging of the arms 52, 54 towards each other will cause the table 50 to fully collapse as would be understood by FIG. 8. In this way, table 10 is in its collapsed and folded condition for easy storage and/or transport. To open the table 50 from its collapsed and folded condition, as should now also be understood, table 50 can be opened/expanded by causing (e.g. pulling) the respective arms 52, 54 away from each until the respective pairs of connector arms rotate to their respective 180 degree alignment, and the respective tabs are received in the respective recesses so as to ensure a fully expanded, sturdy and locked position for table 50.

The foldable side table 50 may include a flexible (e.g. cloth, textile, mesh, canvas, plastic, etc.) material 64 mounted with respect to the first and second arms 52, 54 and the first and second cross-members 56, 58 in a table-like configuration. The flexible material 64 is preferably secured to the first and second arms 52, 54 and directly or indirectly coupled to the first and second cross-members 56, 58 in a table-like configuration. The flexible material 64 may be configured for movement between the open position, such that the flexible material is opened in a table-like manner (See FIGS. 5, 6), and the folded position, such that the flexible material would be folded as would be understood by those skilled in the art (FIG. 8.) The foldable side table 50 may further include one or more features (e.g., pockets, beverage holder) 66 (See FIG. 1). The features 66 may be configured to hold one or more beverages and/or one or more other items. The table material 64 may also be stuffed/folded into a separate pouch during storage and/or transport. The aforementioned pocket may also be provided on the underside of the material to store and protect any items stored therein (e.g. cellphone, etc.) from the elements (rain, sun, and/or any other natural elements or man-made (e.g. a spilled drink, etc.)) when the table 50 is coupled to the chair 12.

The foldable side table 50 preferably interfaces with one or more members positioned on the cross legs 20. The members 40, 42 may be permanently or semi-permanently coupled to the cross legs 20, for example, with fasteners, rivets, nuts/bolts, screws, adhesives, welds, among other attachment options. The members 40, 42 may be positioned on the same side of the cross legs or on opposite sides, as depicted in the figures. The members 40, 42 may be positioned at a distance apart from each other that is about the distance between the two depending hands 60, 62. The members 40, 42 themselves may include respective slots 41, 43 (e.g. FIGS. 4A, 5) and/or the mounting of the respective first member 40 on leg 20 may form slot 41A between the first member 40 and the first leg (e.g. FIG. 4B) and likewise member 42 itself may comprise slot 43 and/or the mounting of the member 42 on the other leg 20 may form slot 43A between the second member 42 and the second leg (identically as shown in FIG. 4B). The slots 41, 43 (and/or 41A, 43A) in the members or formed thereby are configured to receive at least a portion (and/or the entirety) of the depending hand(s) 60, 62 of the foldable side table 50. For example, the hands 60, 62 of the foldable side table 50 may be at least partially or fully inserted into the slot 41, 43 (and/or 41A, 43A) of the brackets 40, 42 (and/or 40A, 42A, i.e. the slots formed thereby) such that the foldable side table 50 extends outwardly from the collapsible chair 12.

During installation, the foldable side table 50, including the hands 60, 62, may be positioned above the brackets 40, 42 and aligned with the slot opening 41, 43, such that in moving the foldable side table 50 in the direction of the base plate members 22A-D, the depending hands are inserted into the corresponding slots. During removal of the foldable side table 50 from the collapsible chair 12, the reverse occurs such that the foldable side table 50 moves in the direction of the top members 24A-24D and disengages from the bracket 40, 42.

The foldable side table 50 may be positioned at a predetermined height along the cross legs of the collapsible chair 12, such that the foldable side table 50 can support items without a user sitting in the chair. For example, the foldable side table 50 may be positioned in proximity to the pivot point of the cross legs, either above or below the pivot point. In one experiment, about 3.34 kg of items were supported by the foldable side table 50 without a user sitting in the chair 12. In another experiment, about 4 kg of items were supported by the foldable side table 50 without a user sitting in the chair 12.

Aesthetically pleasing and/or different patterns can be, if desired, silkscreened, embroidered, printed, and/or otherwise provided on the fabric cover 64 to change the appearance of the table.

For the avoidance of doubt, it should also be understood that the first and second members 40, 42 (and/or 40A, 4B) may be associated with the foldable table such that a foldable side table assembly is provided for use with a chair having at least a first leg and a second leg, wherein the foldable side table assembly comprises at least a first member couplable to the first leg and a second member couplable to the second leg, wherein the first member includes a slot and/or the mounting of the first member on the first leg forms a slot between the first member and the first leg and wherein the second member includes a slot and/or the mounting of the second member on the second leg forms a slot between the second member and the second leg; a first arm and a second arm, a first hand depending from the first arm and removably insertable into the slot associated with the first member, and a second hand depending from the second arm and removably insertable into the slot associated with the second member; a first cross-member assembly coupled intermediate the first and second arms and a second cross-member assembly coupled intermediate the first and second arms; and a flexible covering coupled to the first and second arms.

Although the present disclosure has been described with reference to exemplary implementations, the present disclosure is not limited by or to such exemplary implementations. Rather, various modifications, refinements and/or alternative implementations may be adopted without departing from the spirit or scope of the present disclosure.

What is claimed is:

1. A combination chair and foldable side table, wherein the combination comprises:

the chair, wherein the chair comprises:

at least a first leg and a second leg;

at least a first member coupled to the first leg and a second member coupled to the second leg, wherein the first member includes a slot and/or the mounting of the first member on the first leg forms a slot between the first member and the first leg and wherein the second member includes a slot and/or the mounting of the second member on the second leg forms a slot between the second member and the second leg; and the foldable side table comprises:

a first arm and a second arm, a first hand depending from the first arm and removably insertable into the slot associated with the first member, and a second hand depending from the second arm and removably insertable into the slot associated with the second member;

a first cross-member assembly coupled intermediate the first and second arms and a second cross-member assembly coupled intermediate the first and second arms; and a flexible covering coupled to the first and second arms.

2. The combination as claimed in claim 1, wherein both the first cross-member assembly and the second cross-member assembly of the foldable side table are configured for movement between (i) an open position when the first and second arms are at a first spaced distance from each other when the foldable side table is in a deployed position and (ii) a folded position such that the first and second arms are at a distance that is less than the first spaced distance from each other when the foldable side table is in a collapsed position.

3. The combination as claimed in claim 2, wherein the first and second arms are at the first spaced distance from each other when the hands are in their respective slots.

4. The combination as claimed in claim 1, wherein the chair is at least one of collapsible and foldable.

5. The combination as claimed in claim 1, wherein the hands are integrally formed on the respective arms.

6. The combination as claimed in claim 1, wherein the first member includes the slot and the second member includes the slot.

7. The combination as claimed in claim 1, wherein:

the mounting of the first member on the first leg forms the slot between the first member and the first leg, and the mounting of the second member on the second leg forms the slot between the second member and the second leg.

8. The combination as claimed in claim 1, wherein the flexible covering is secured to the first and second arms and coupled to the first and second cross-members in a table-like configuration, wherein the flexible covering is configured for movement between an open position when the flexible covering is opened in the table-like manner and a folded position when the flexible covering is folded.

9. A foldable side table comprising:

a first arm and a second arm, only a first hand depending from the first arm and removably couplable to a first leg of a chair, wherein the first leg of the chair has coupled thereto a first member having a slot associated therewith, and wherein the first hand is insertable into the slot associated with the first member, and only a second hand depending from the second arm and removably couplable to a second leg of the chair, wherein the second leg of the chair has coupled thereto a second member having a slot associated therewith, and wherein the second hand is insertable into the slot associated with the second member;

a first cross-member assembly coupled intermediate the first and second arms and a second cross-member assembly coupled intermediate the first and second arms; and a flexible covering coupled to the first and second arms.

10. The foldable side table as claimed in claim 9, wherein both the first cross-member assembly and the second cross-member assembly of the foldable side table are configured for movement between (i) an open position when the first and second arms are at a first spaced distance from each other when the foldable side table is in a deployed position and (ii) a folded position such that the first and second arms are at a distance that is less than the first spaced distance from each other when the foldable side table is in a collapsed position.

11. The foldable side table as claimed in claim 10, wherein the first and second arms are at the first spaced distance from each other when the hands are in their respective slots.

12. The foldable side table as claimed in claim 9, wherein the chair is at least one of collapsible and foldable.

13. The foldable side table as claimed in claim 9, wherein the first and second hands are integrally formed on the respective arms.

14. The foldable side table as claimed in claim 9, wherein the flexible covering is secured to the first and second arms and coupled to the first and second cross-members in a table-like configuration, wherein the flexible covering is configured for movement between an open position when the flexible covering is opened in the table-like manner and a folded position when the flexible covering is folded.

15. A foldable side table comprising:

a first arm and a second arm, only a first hand, wherein the first hand depends from the first arm and is removably couplable to a first leg of a chair, wherein the first leg of the chair has coupled thereto a first member having a slot associated therewith, and wherein the first hand is insertable into the slot associated with the first member, and a first cross-member assembly coupled intermediate the first and second arms and a second cross-member assembly coupled intermediate the first and second arms; and a flexible covering coupled to the first and second arms.

16. The foldable side table as claimed in claim 15, wherein both the first cross-member assembly and the second cross-member assembly of the foldable side table are configured for movement between (i) an open position when the first and second arms are at a first spaced distance from each when the foldable side table is in a deployed position and (ii) a folded position such that the first and second arms are at a distance that is less than the first spaced distance from each other when the foldable side table is in a collapsed position.

17. The foldable side table as claimed in claim 15, wherein the flexible covering is secured to the first and second arms and coupled to the first and second cross-members in a table-like configuration, wherein the flexible covering is configured for movement between an open position when the flexible covering is opened in the table-like manner and a folded position when the flexible covering is folded.

* * * * *